US006129210A

United States Patent [19]

Rustemeyer et al.

[11] Patent Number: 6,129,210

[45] Date of Patent: Oct. 10, 2000

[54] UTILITY BOX WRAP

[75] Inventors: Jeffrey A. Rustemeyer, Naperville, Ill.; Joseph Fiore, Lebanon, Pa.; Donald E. Godshaw, Evanston; Andrzej Redzisz, Skokie, both of Ill.

[73] Assignee: Plano Molding Company, Plano, Ill.

[21] Appl. No.: 09/498,331

[22] Filed: Feb. 4, 2000

[51] Int. Cl.[7] ..... B65D 30/20; B65D 30/22

[52] U.S. Cl. ..... 206/736; 206/216; 383/38; 190/1

[58] Field of Search ..... 206/216, 736, 206/756, 759, 760, 45.24; 383/38, 39, 40; 190/1, 107, 109

[56] References Cited

U.S. PATENT DOCUMENTS

| | | | |
|---|---|---|---|
| 36,710 | 10/1862 | Hamlin . | |
| 1,663,388 | 3/1928 | Rona . | |
| 2,334,895 | 11/1943 | Bracken . | |
| 2,679,877 | 6/1954 | Leggett . | |
| 2,754,867 | 7/1956 | Langer . | |
| 2,887,196 | 5/1959 | Davis . | |
| 2,985,266 | 5/1961 | Pelavin . | |
| 3,827,552 | 8/1974 | Janhonen . | |
| 4,453,637 | 6/1984 | Mazur . | |
| 5,002,401 | 3/1991 | Blackman . | |
| 5,360,215 | 11/1994 | Ruben | 383/38 |
| 5,394,964 | 3/1995 | White | 190/1 |
| 5,547,077 | 8/1996 | Wang . | |
| 5,743,649 | 4/1998 | Gonzalez | 383/39 |
| 5,779,033 | 7/1998 | Roegner . | |

*Primary Examiner*—Jacob K. Ackun
*Attorney, Agent, or Firm*—Richard A. Zachar

[57] ABSTRACT

A storage and carry wrap for a plurality of storage containers of relatively rigid material comprises a generally rectangularly shaped base panel having an inner face, an outer face, and opposed ends. A handle is affixed to the base panel midway between the ends. A plurality of pockets or receptacles are affixed to the base panel and are longitudinally disposed along the inner face thereof for releasably receiving the containers. The portions of the base panel on each side of the handle are foldable along spaced-apart transversely extending fold lines to each assume a generally U-shaped configuration with the receptacles being disposed in confronting relation. A cover affixed to the base panel proximal the handle includes first and second cover panel sections extending in opposite directions from the handle, and connects to the base panel portions when folded in their U-shaped configuration.

3 Claims, 4 Drawing Sheets

UTILITY BOX WRAP

Present invention is generally directed to arrangements for storage, transport and display of relatively rigid containers and, more particularly, to an improved soft sided wrap for storing and transporting utility boxes.

BACKGROUND OF THE INVENTION

There has long been a need for means to organize, store and transport hardware items, electronics components, plumbing items, fishing tackle and the like. A great variety of organizers have been developed over the years to satisfy such needs. More recently, manufacturers have produced relatively small, transparent or translucent plastic containers, often referred to as utility boxes, having snap fit lids and multiple compartments. Some of these utility boxes are designed to permit the user to alter the size and number of the compartments. For example, Plano Molding Company, the assignee of the present invention, produces a line of injection molded plastic utility boxes under the mark "StowAway" which vary in size from 13¾ inches×9⅛ inches×2 inches at the large end to 4⅝ inches×2⅞ inches×1 inch at the smaller end. These utility boxes are inexpensive and have become extremely popular for a variety of user needs. Typically, a user maintains several of the utility boxes for organizing, devoting each box to a particular class, category or type of items.

Racks have been developed to store a number of the utility boxes. Some of the racks have handles so that they, and the utility boxes, may be transported. Users, however, often prefer to simply store and transport a number of the utility boxes in soft sided bags, and a variety of specialty bags have been produced for this purpose.

One drawback of existing transportable racks and bags for holding utility boxes arises from the fact that they do not permit the user to view the entire contents of all of the utility boxes at the same time while the boxes remain in the storage unit. Racks permit the user to view only the end portions of the utility boxes, while bags permit viewing of only the uppermost box (if stacked) or the end portions of several of the boxes, depending on the orientation of the utility boxes stored in the bags. Because each utility box normally has multiple compartments holding diverse items, it is often necessary for the user to remove several of the boxes from the rack or bag in order to find the desired item or to select the desired utility box.

Accordingly, there remains a need for a transportable storage device for utility boxes which affords the user the ability to view the entire contents of all of the utility boxes simultaneously and, alternatively, to selectively view the contents of, and obtain access to, some (but not all) of them simultaneously.

So-called "wraps" have long been used to store tools and various containers and items. Examples of such wraps are shown and described in U.S. Pat. Nos. 36,710; 2,679,877; 3,827,552; 5,002,401; 5,547,077; and 5,779,033. In each of these prior art wrap type storage and transport units, the items are stored in pockets provided along a flexible sheet which is foldable to assume a more compact and transportable condition. The '077 patent to Wang discloses a wrap comprising an elongated strip of flexible material with a series of pockets attached to the strip. The wrap, when in an unfolded condition, can be hung by a hook from a hole at one end of the strip to display the contents of each of the pockets.

None of the foregoing prior art wraps are capable of satisfying the requirements noted above. In particular, while the wrap disclosed by Wang would permit the contents of all utility boxes to be viewed at the same time (when hung and unwrapped), Wang fails to disclose means for transporting the wrap and its contents, or for permitting visual access to the entire contents of some, but not all, of the utility boxes while all the boxes remain stored.

SUMMARY OF THE INVENTION

In accordance with the invention a wrap type storage and carrier unit for utility boxes is provided which in a totally unwrapped condition can be hung from one end exposing all the utility boxes and the compartments thereof, which can be fully wrapped to assume an attaché case-like configuration for convenient transport, and which can be partially unwrapped from its fully wrapped condition to expose and permit access to some, but not all, of the utility boxes.

In one aspect the invention comprises a plurality of storage containers or utility boxes and a holder therefor. The holder comprises a generally rectangularly shaped base panel or sheet having an inner face, an outer face, and opposed ends. A handle is affixed to the base panel midway between the ends thereof. A plurality of container receptacles are affixed to the base panel and are longitudinally disposed along the inner face thereof. The portion of the base panel on each side of the handle is foldable along spaced-apart transversely extending fold lines to permit such portion to be folded to a generally U-shaped configuration with the container receptacles being disposed in confronting relation. A cover is affixed to the base panel proximal the handle. The cover includes first and second cover panel sections, respectively extending in wing-like fashion in opposite directions from the handle. First connectors are affixed to the base panel near each of the opposed ends thereof and cooperating connectors are affixed to each of the cover sections, the first connectors and the cooperating connectors being matingly engageable when the base panel portions are folded to the U-shaped configuration to securely retain them in their folded condition.

In accordance with another aspect of the invention, an improved transportable utility box storage and carrier wrap is provided. The wrap comprises a spine, a handle affixed to the spine, a pair of inner panels and a pair of outer panels. Each of the panels has a free end and an opposed end, with the opposed end of each of the panels being affixed to the spine whereby the panels extend from the spine in the fashion of pages of a book. The inner panels are longer than the outer panels and each has an inner face and an outer face. A plurality of container receptacles are affixed to the inner face of each of the inner panels. Each of the inner panels is selectably foldable about transverse fold lines to assume a generally U-shaped configuration with the receptacles being in confronting relation. Each of the outer panels is foldable to overlay a portion of the outer face of the adjacent of the inner panels when the latter are folded to their U-shaped configuration. Connecting means are provided to secure each of the outer panels to the adjacent of the inner panels when the latter are folded to the U-shaped configuration.

Other features and advantages of the invention will become apparent from the drawings and detailed description to follow.

BRIEF DESCRIPTION OF THE DRAWINGS

A full and enabling disclosure of the present invention including the best mode thereof, directed to one of ordinary skill in the art, is set forth in the specification, which makes reference to the appended figures, wherein like numerals are used to denote like parts throughout, in which.

Figure 1:
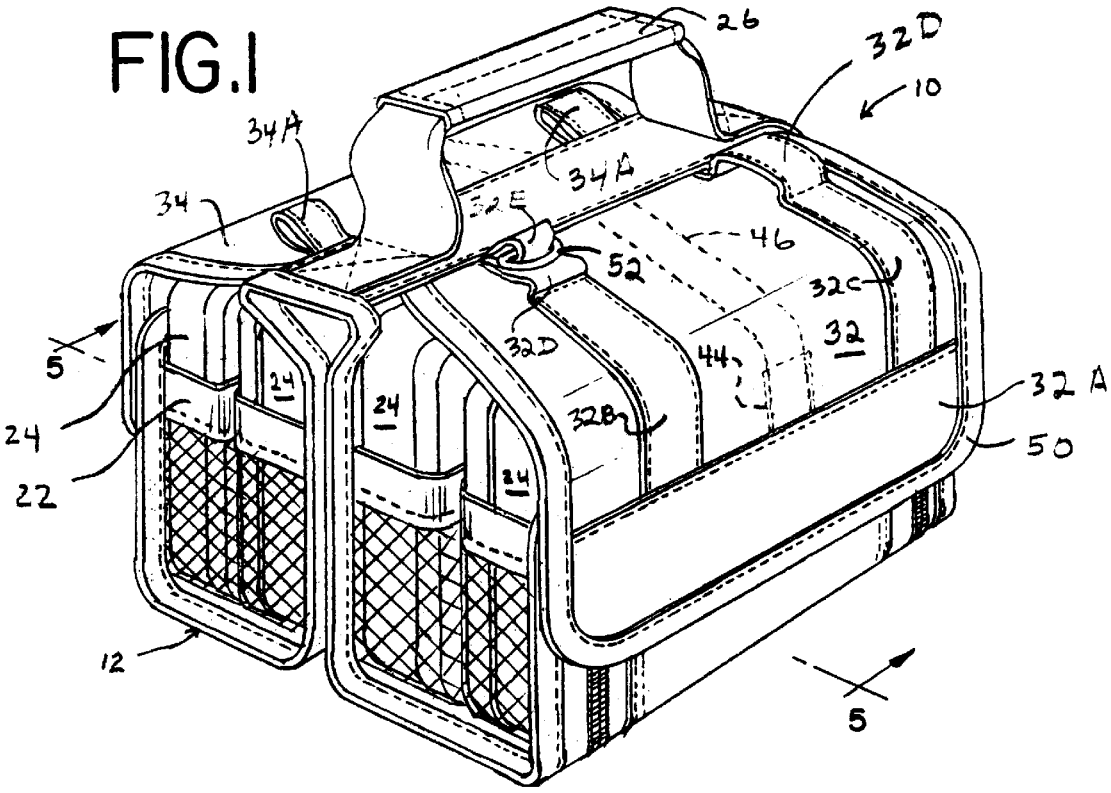
FIG. 1 is a perspective view of a utility box storage and carrying case in its fully wrapped condition according to the present invention.

Repeat use of reference characters in the present specification and drawings is intended to represent same or analogous features of elements of the invention.

DETAILED DESCRIPTION OF THE PREFERRED EMBODIMENT

Referring now to the drawings, a soft sided carrying case 10 in accordance with the invention comprises an elongated base panel 12 (best shown in FIG. 2) having an inner face 14, an outer face 16 and opposed free ends 18, 20. Disposed longitudinally along the inner face 14 of the base panel 12 and affixed thereto are a plurality of container receptacles or pockets 22 formed of mesh or netting material. Each pocket 22 is sized to accommodate at least one hard-sided organizer case or utility box 24 such as, for example, the above noted StowAway™ utility boxes available from Plano Molding Company. A carrying handle or strap 26 is affixed to the face panel 12 midway between the free ends 18, 20 thereof. Preferably, a pair of transversely extending strips 28, 30 of rubber or elastomeric material are affixed to the outer face 16 of the base panel 12 to provide a wear surface for the case 10 when the same is in its fully wrapped and transportable condition as show in FIG. 5. A cover in the form of oppositely extending cover panel sections 32, 34 are each affixed to the base panel 12 proximal the handle 26. Storage containers 24 are retained in their respective pockets 22 by means of straps 36, each of the straps 36 having one end affixed to the inner face of the base panel 12 and the other end secured to a pocket 22 by snap connectors.

Figure 2:
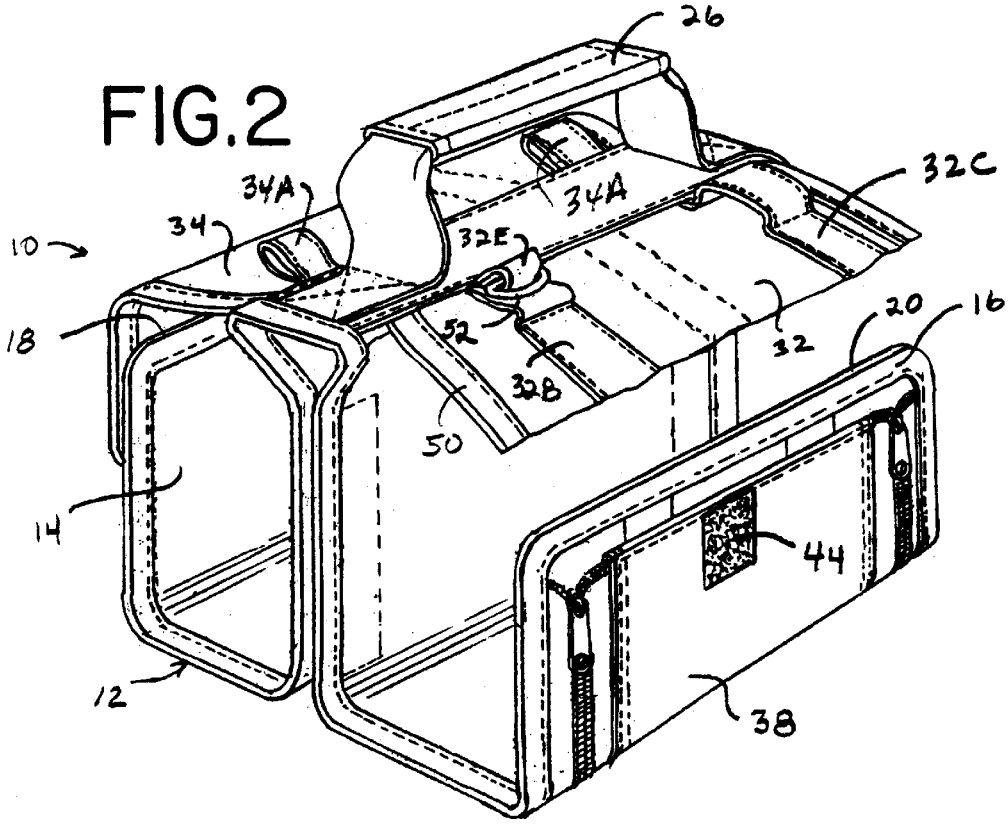
FIG. 2 is a perspective view similar to FIG. 1 of the carrying case with the utility boxes and pockets removed.
Figure 5:
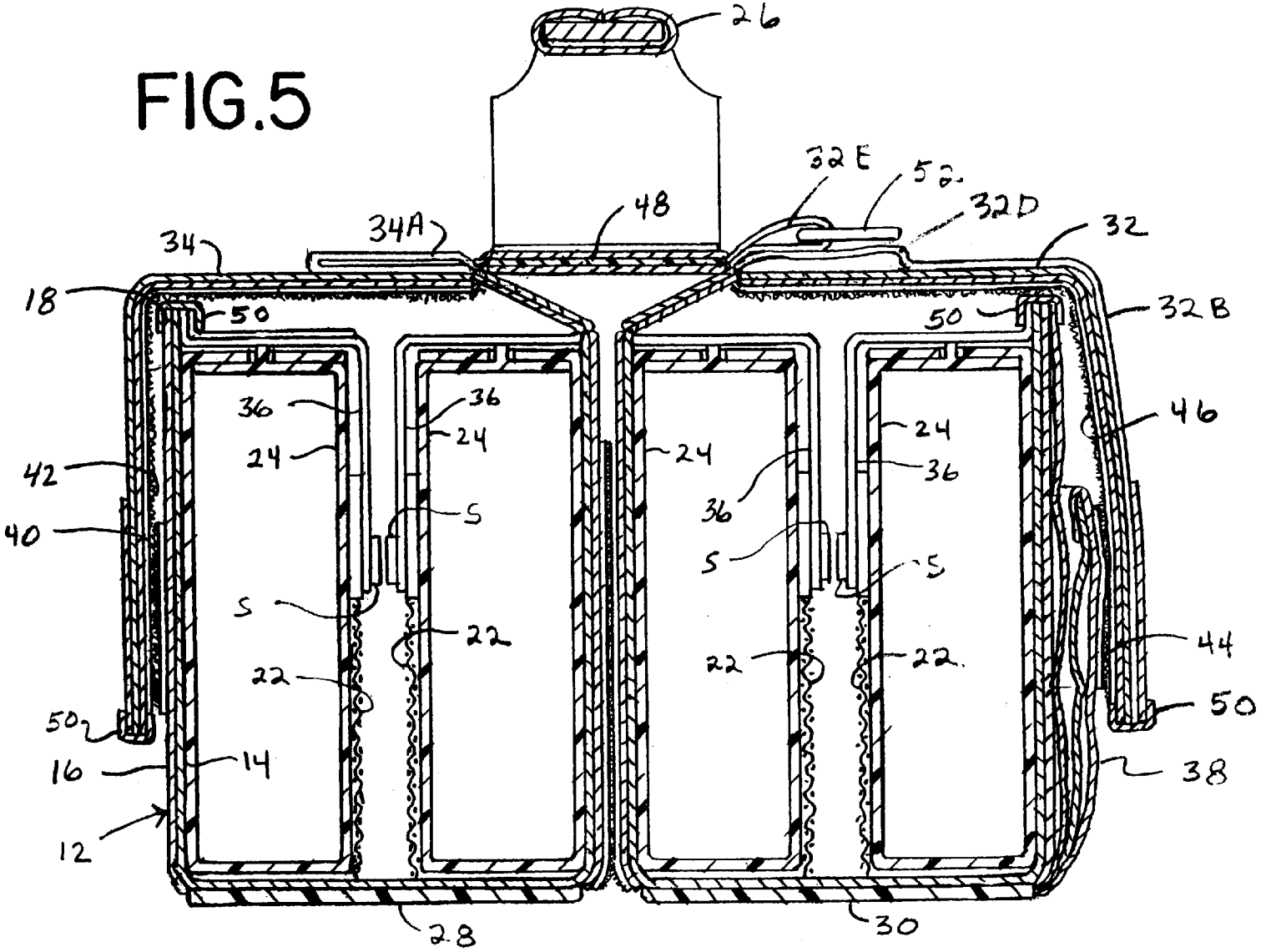
FIG. 5 is a sectional view taken as indicated, along the line 5—5 of FIG. 1.

As illustrated, the portion of the base panel 12 on each side of the handle 26 is foldable along spaced-apart transversely extending fold lines to assume a generally U-shaped configuration with adjacent containers 24 being disposed in side-by-side confronting relation (as best shown in FIGS. 1 and 5). Cover panel sections 32, 34 are seen to respectively extend in wing-like fashion outwardly from the handle 26 in opposite directions to overlie the free end portions of the base panel when the same are disposed in their U-shaped configuration. As best shown in FIGS. 2 and 5, in the illustrated embodiment a zippered pocket 38 is stitched to the outer face 16 of the base panel 12 adjacent the free end 20 thereof. In order to secure the cover sections 32, 34 to the base panel 12, the base panel outer surface 16 is provided with a strip of Velcro material 40 near the free end 18 and the inner face of the cover section 34 is provided with an elongated strip 42 of Velcro. In like fashion the outer face of pocket 38 is provided a strip of Velcro 44 for engagement with a cooperating Velcro strip 46 disposed on the inner face of cover section 32.

In the presently preferred form illustrated herein, the base panel 12 of case 10 is of two ply construction, the inner face 14 being of canvas fabric and the outer face being of a nylon material. As best shown in FIG. 5, the base panel 12 is reinforced by a transversely extending strip 48 of rigid material in the region thereof below the handle so that such region forms a spine like that of a book. The cover sections 32, 34 each are also of two ply construction, the inner face or layer being of nylon material, the outer face or layer being of canvas material.

The plies forming the base panel 12 and cover panels 32, 34 are stitched together along their perimeters in conventional fashion using fabric edging tape or ribbon 50 to provide reinforcement against tearing (see FIG. 5).

As best shown in FIGS. 1 and 5, the cover section 32 of the illustrated embodiment has an outer reinforcing layer 32A of canvas affixed thereto by stitching. A plurality of longitudinally extending canvas strips 32B, 32C are stitched to the outer face of the cover section 32 to form sets of aligned loops 32D near one side of the handle 26 through which various elongated items may be inserted, carried and retained. A pair of aligned loops of canvas 34A are stitched to the opposite side of the handle 26 for the same purpose, and a smaller loop of canvas 32E is formed to retain a ring 52 which may be used as a means for securing items to the case 10.

Figure 3:
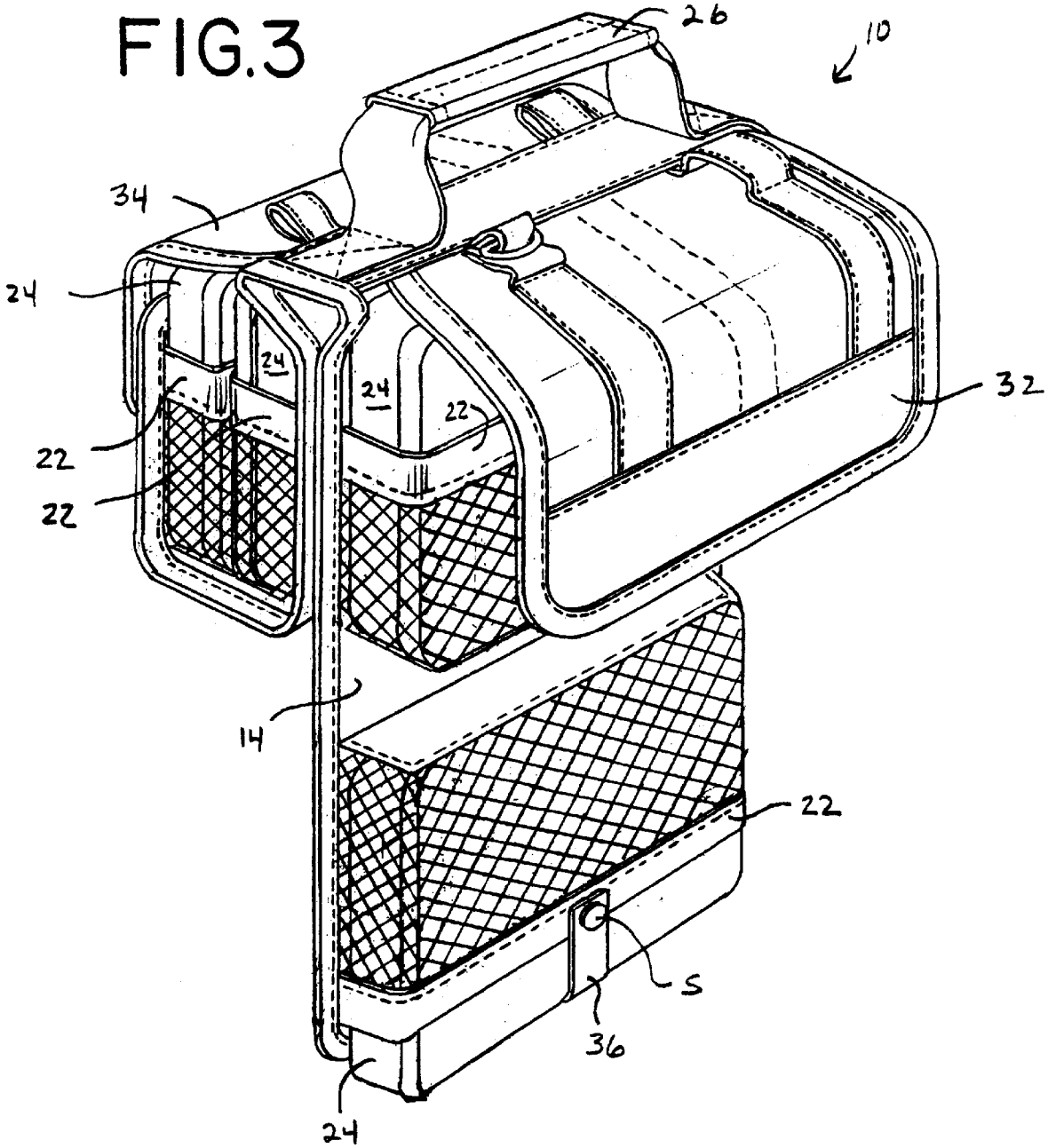
FIG. 3 is a perspective view of the case of FIGS. 1 and 2 in a partially extended position.
Figure 4:
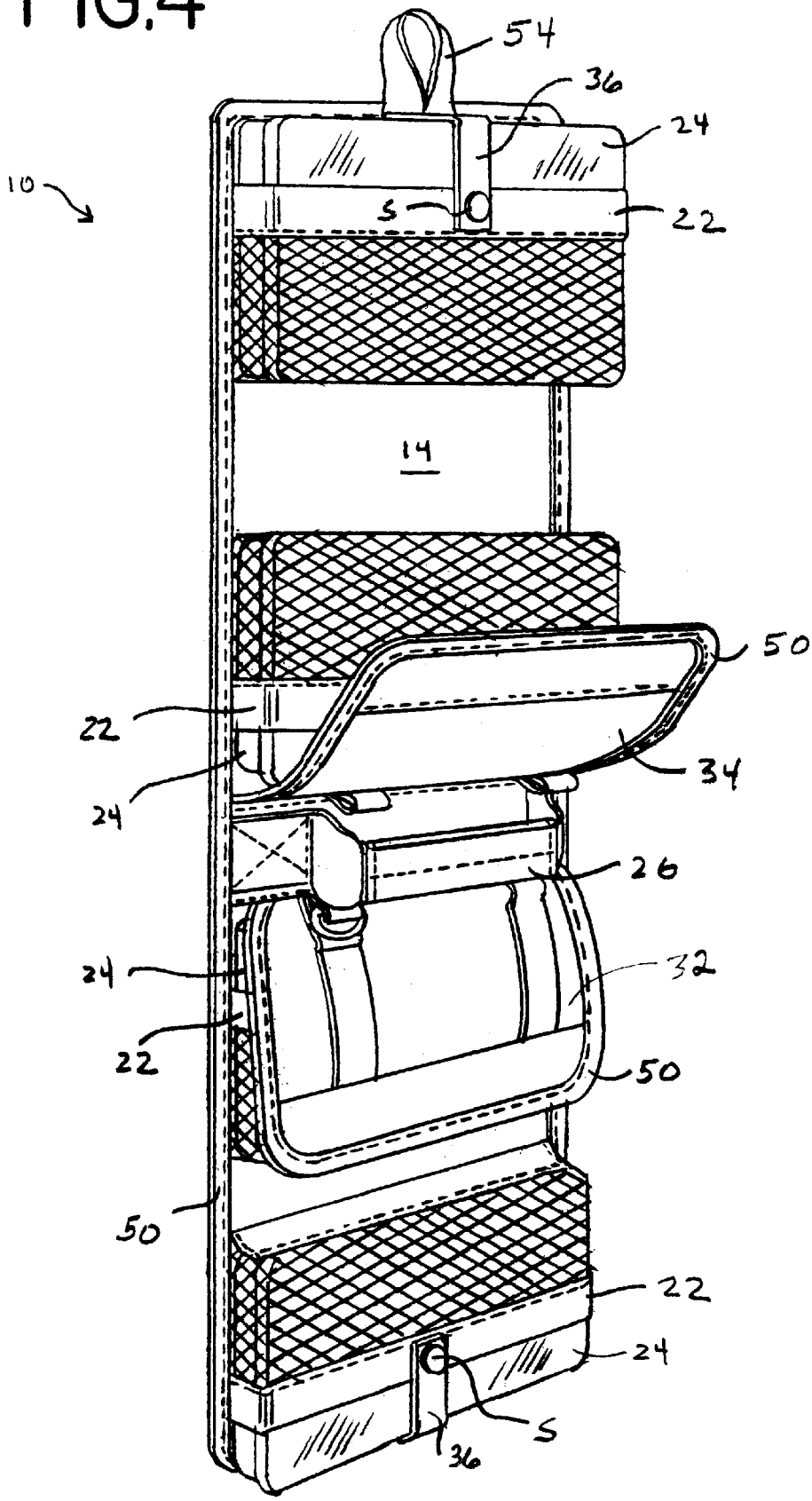
FIG. 4 is a perspective view of the case of FIGS. 1–3 in a fully extended position.

The case 10 can be partially opened as shown in FIG. 3 for access to some but not all of the rigid containers 24 or can be fully opened as shown in FIG. 4 and hung by loop 54 to a suitable hook (not shown) with all the containers 24 fully visible and accessible.

It should be readily apparent that the case 10 of the present invention could include alternative container pocket arrangements. For example, instead of one large pocket extending transversely full width across the base panel 12, a series of smaller pockets, each holding a smaller rigid container could be substituted. Numerous additional zippered pockets, similar to the pocket 38 could be added as desired. The base panel 12 and cover sections 32, 34 could be formed of other material and of fewer or additional plies.

Thus, it is to be understood by those with ordinary skill in the art that the foregoing presently preferred embodiment is exemplary only and that the intended description thereof is likewise by way of words of example rather than words of limitation, and their use does not preclude inclusion such modifications, variations and/or additions to the present invention as would be readily apparent to one of ordinary skill in the art, the scope of the present invention being set forth in the appended claims.

What is claimed is:

1. In combination, a plurality of storage containers of relatively rigid material and a holder for said containers, said holder comprising a generally rectangularly shaped base panel having an inner face, an outer face, and opposed ends, handle means affixed to said base panel midway between said ends, a plurality of container receptacles affixed to said base panel and longitudinally disposed along said inner face, the portion of said base panel on each side of said handle means being foldable along spaced-apart transversely extending fold lines to a generally U-shaped configuration with said container receptacles being disposed in confronting relation, cover panel means affixed to said base panel proximal said handle, said cover panel means including first and second cover panel sections respectively extending in wing-like fashion in opposite directions from said handle means, each of said cover sections having an inner face and an outer face, first connector means affixed to said base panel near each of the said opposed ends, cooperating connector means affixed to each of said cover sections, said first connector means and said cooperating connector means being matingly engageable when the base panel portions are folded to said U-shaped configuration.

2. A storage and carry wrap for a plurality of storage containers of relatively rigid material, said wrap comprising a generally rectangularly shaped base panel having an inner face, an outer face, and opposed ends, handle means affixed to said base panel midway between said ends, a plurality of receptacles affixed to said base panel and longitudinally disposed along said inner face for releasably receiving said containers, the portion of said base panel on each side of said handle means being foldable along spaced-apart transversely extending fold lines to assume a generally U-shaped configuration with said receptacles being disposed in confronting relation, cover panel means affixed to said base panel proximal said handle means, said cover panel means including first and second cover panel sections extending in opposite directions from said handle, and means for connecting cover sections to said base panel when folded in said U-shaped configuration.

3. A transportable utility box storage wrap, said wrap comprising a spine, a handle affixed to the spine, a pair of inner panels and a pair of outer panels, each of said panels having a free end and an opposed end, the opposed end of each of said panels being affixed to said spine whereby said panels extend from said spine in the fashion of pages of a book, said inner panels being longer than said outer panels and each having an inner face and an outer face, a plurality of container receptacles affixed to said inner face of each of said inner panels, said inner panels each being selectably foldable about transverse fold lines to assume a generally U-shaped configuration with said receptacles being in confronting relation, each of said outer panels being foldable to overlay a portion of the outer face of the adjacent of said inner panels when the latter is folded to said U-shaped configuration, and means for connecting each of said outer panels to the adjacent of said inner panels when the latter is folded to said U-shaped configuration.

* * * * *